United States Patent [19]

Klygis

[11] 4,218,086

[45] Aug. 19, 1980

[54] BOTTLE CARRIER

[75] Inventor: Mindaugas J. Klygis, Barrington, Ill.

[73] Assignee: Illinois Tool Works Inc., Chicago, Ill.

[21] Appl. No.: 961,323

[22] Filed: Nov. 16, 1978

[51] Int. Cl.[3] ..... B65D 71/00

[52] U.S. Cl. ..... 294/87.2; 206/153; 206/158

[58] Field of Search ..... 294/87.2, 87.28; 206/145, 153, 158, 175, 199, 427; 224/45 AA, 45 AB, 45 BA

[56] References Cited

U.S. PATENT DOCUMENTS

| | | | |
|---|---|---|---|
| 2,737,326 | 3/1956 | Toensmeier | 206/153 X |
| 3,016,259 | 1/1962 | Lawrence | 294/87.2 |
| 3,123,213 | 3/1964 | Kulig | 206/158 |
| 3,281,180 | 10/1966 | Spery | 294/87.2 |
| 3,387,879 | 6/1968 | Wood | 294/87.2 |
| 3,640,563 | 2/1972 | Wood | 294/87.2 |
| 3,860,281 | 1/1975 | Wood | 294/87.2 |
| 3,985,228 | 10/1976 | Klygis | 294/87.2 X |

*Primary Examiner*—Johnny D. Cherry

*Attorney, Agent, or Firm*—Thomas W. Buckman; Robert W. Beart

[57] ABSTRACT

A package for a linear array of bottles or the like and a carrier included in the package made of sheet plastic material configured to be generally tubular, having side walls diverging downwardly from an upper region which is interrupted by longitudinally spaced openings for receiving the inserted neck portions of the bottles in supporting engagement with at least side marginal edges of the apertures. The bottom wall of the carrier is designed to include lower apertures formed therein in registry with the upper apertures. The portion of the bottom wall intermediate the lower apertures is V-shaped in cross section permitting lateral forces to decrease the upper aperture dimension as the carrier and package is grasped in regions intermediate the bottles.

8 Claims, 5 Drawing Figures

10
14
15
16
17
18
19
20
21
22
24
26
28
29
30
32
34
36
38
40
42
44
46
d2
d1
14a
15a
16a
17a
18a
19a
20a
21a
22a
24a
26a
28a
34a
36a
42a
44a 5
10
12
18
19
20
22
24
26
28
34
36
38
40
50
52
54
56
58

BOTTLE CARRIER

BACKGROUND OF THE INVENTION

The invention relates generally to packages for bottles or the like and carriers therefor. Such bottles are generally of the type including a reduced neck portion above an expanded body portion. The neck portion generally terminates with a cap-type closure and the neck portion or the region adjacent the cap is generally provided with an annular flange or radially enlarged bead. It is this flange or bead or in some instances the cap itself which is utilized as a support for a carrier of the type defined herein. Various forms of carriers for these bottles are available and are made from sheet plastic material, cardboard or the like which may be initially blanked from flat sheet form and folded to a generally tubular form. The prior art carriers are typically provided with upper and lower apertures to receive the neck region of the bottle so the region beneath the cap or the cap is supported by the upper apertures. Examples of carriers of this general type are shown in U.S. Pat. Nos. 3,985,228; 3,784,246 and 3,016,259.

SUMMARY OF THE INVENTION

According to the present invention, the carrier is particularly designed for packaging a plurality of bottles in a linear array. The carrier is best utilized to carry two large bottle containers in a single row. However, the number of bottles accommodated by this invention may vary. The carrier is one piece and formed from a sheet of resilient plastic sheet material, such as high density polyethylene or similar material. A sheet of such material is stamped into a blank which is thereafter folded to a tubular device including a pair of side wall portions having spaced apertures formed at the upper regions thereof. The blank also is configured to include a pair of bottom wall halves with half apertures formed therein. The bottom wall halves are folded beneath the upper apertures and affixed to one another so the half apertures form lower openings in registry with the upper apertures.

A particular feature of this invention is the inverted V-shaped bottom wall extending between spaced bottles. Such an upwardly directed V-shaped wall permits lateral forces exerted at the lower edge of the side walls to readily deflect the side walls inwardly toward one another with a corresponding reduction in the transverse dimension of te upper aperture. The reduction in the upper aperture renders the package more secure.

Therefore, an object of the invention is to provide a carrier of the above type for an array of bottles which creates a secure positive abutment between the necks of the bottles and the carrier as it is grasped by a user.

Another object of the invention is to provide a carrier which is adapted to easy insertion of bottles therein.

Still a further object of the invention is to provide a carrier which is particularly designed to reduce material and still have sufficient rigidity and superior bottle carrying capabilities.

The above and other objects of the invention will be in part obvious and will be hereinafter more fully pointed out in the detailed description of the accompanying drawings.

DETAILED DESCRIPTION OF THE PREFERRED EMBODIMENTS

Figure 1:
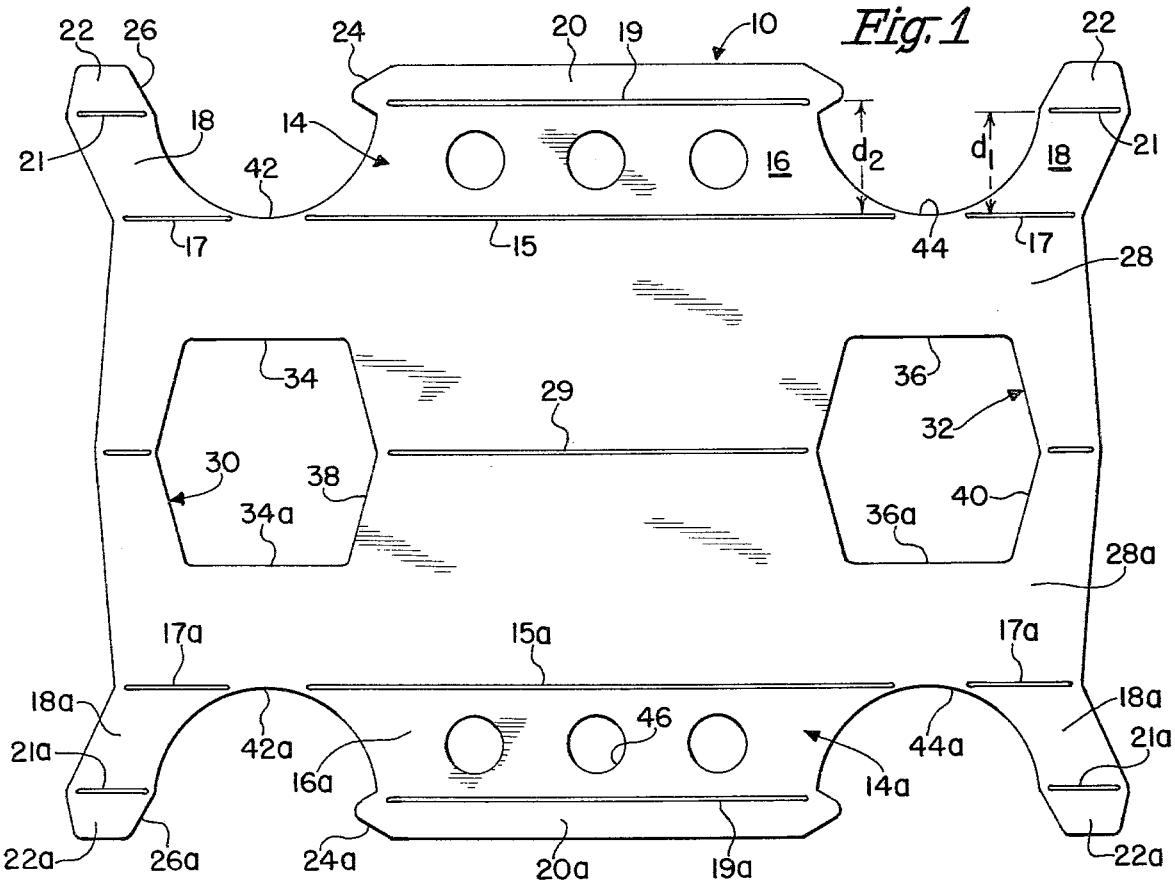
FIG. 1 is a plan view of the blank from which the carrier is formed.

Referring now to the accompanying drawing, and particularly FIG. 1 at this time, a carrier blank is shown before the formation thereof into a carrier for the package. It should be understood that these carriers can be formed from a continuous strip of plastic sheet material with each blank separated from its adjacent blank either along the longitudinal edge or transverse edge.

The blank forming carrier 10 will be seen to include identical but opposing portions formed on either side of a central bend line 29. Hereinafter identical but opposing portions will be identified by the same reference numerals with the addition of the suffix "a".

Side wall portions 28 and 28*a* are separated from each other by fold or bend line 29 and from their respective one-half bottom wall portions 14 and 14*a* by bend or fold lines 15,15*a*. It should be noted that the opposing bottom wall portions 14,14*a* actually consist of a central bottom wall region 16,16*a* and a pair of outermost end wall regions 18,18*a* on each of 14 and 14*a*. The end wall regions are separated from the central wall regions by a half aperture opening 42,44 and 42*a*,44*a*.

The blank is configured to include a pair of generally polygonal longitudinally spaced apertures 30 and 32 which are longitudinally bisected by the fold line 29 so that a pair of side edges 34,34*a* and 36,36*a* in each aperture are positioned in side walls 28,28*a*. The bottom wall half apertures 42,44 and 42*a*,44*a* are positioned to be in registry with the upper apertures 30,32 when the bottom wall is formed in the carrier.

In creating the carrier 10 from the blank, the side wall regions are bent downwardly about the fold line 29 and the bottom wall regions 14,14*a* are bent inwardly beneath the side walls with opposing marginal edges of the bottom walls affixed such as by stapling, heat sealing or the like. Central tab members 20,20*a* and end tabs 22,22*a* are formed in the blank adjacent the marginal edges of the bottom walls to be bent downwardly about bend lines 19,19*a* and 21,21*a*, respectively, to assume a face to face relationship to facilitate the securement of one bottom wall half to the other.

Figure 2:
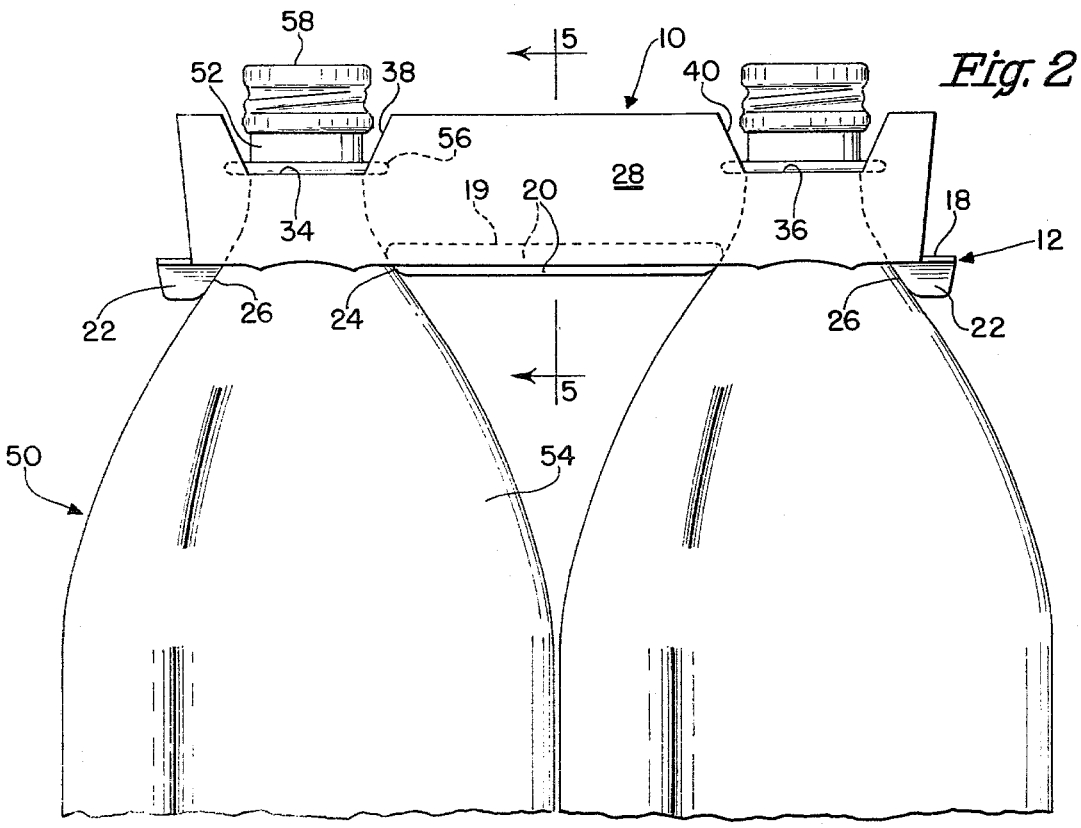
FIG. 2 is a side elevational view of the formed carrier in association with containers therewith as a package.
Figure 3:
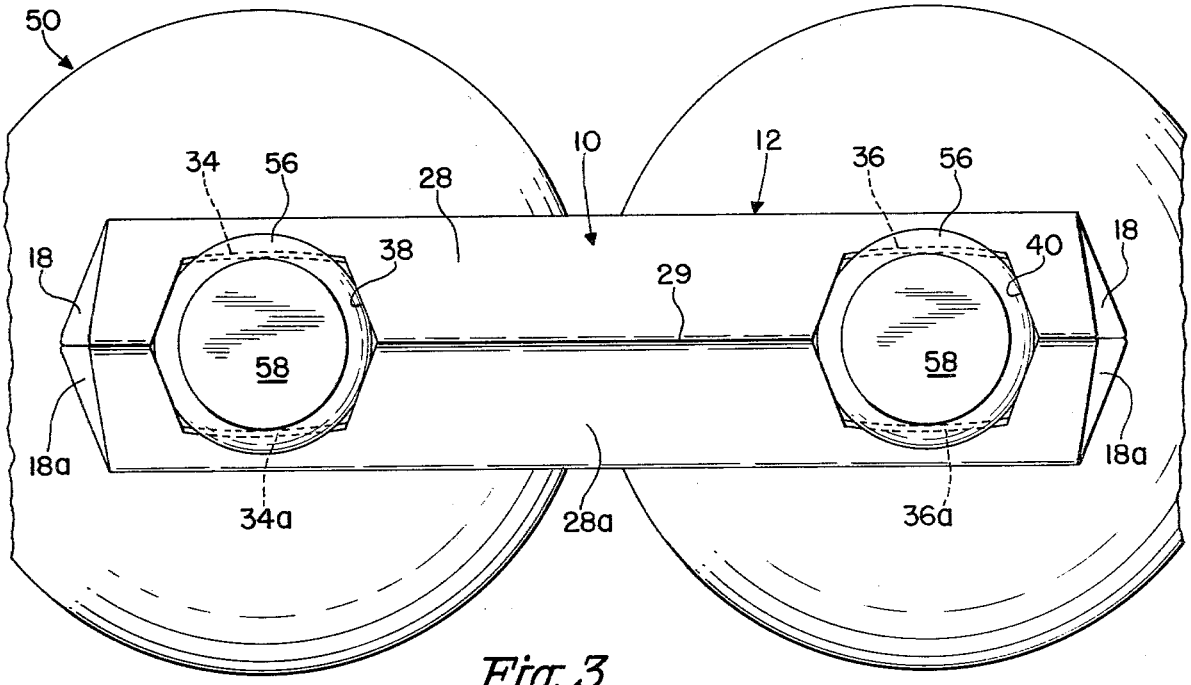
FIG. 3 is a top plan view of the carrier and containers shown in FIG. 2.
Figure 4:
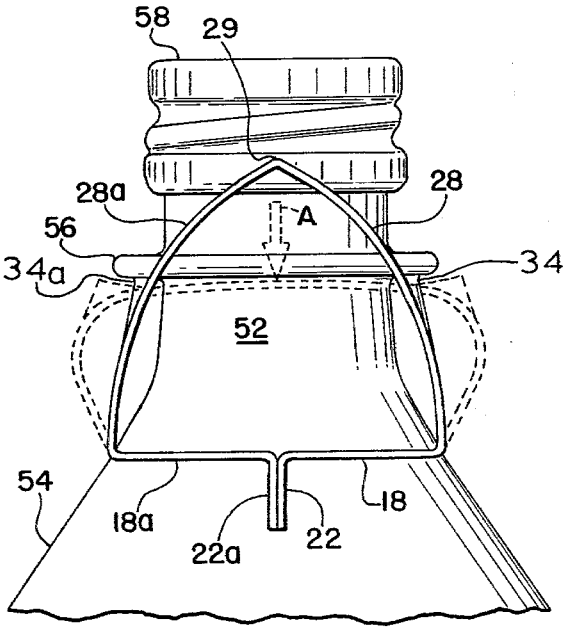
FIG. 4 is an end view of the package of FIG. 3.

The carrier 10 thus configured is readily adaptable to form a package 12 with bottles 50 as shown more clearly in FIGS. 2–4. With one upper aperture 30 registering with now formed lower aperture 42,42*a* and the longitudinally spaced other aperture 32 registering with its lower aperture 44,44*a*, a pair of large bottles may be quickly and reliably associated therewith to form an integral and efficient package.

Turning to FIG. 4, the ease of insertion of the bottles in the carrier 10 will be readily appreciated. With the upper extremity of the bottle in registry with the apertures of the carrier, the carrier is compressed downwardly as by a force A in the vicinity of one bottle which has the effect of bulging the side walls 28,28*a* outwardly and increasing the transverse dimensions between the side edges 34,34*a* and 36,36*a* of holes 30 and 32, respectively. Thus, an enlarged ring 56 of the associated bottles may enter and rest upon the same edges just referred to when the force A is released, thus forming a shoulder to facilitate the carrying of the bottles.

Obviously, the same compression force A can be readily utilized to remove one of the bottles from the package by the user.

Figure 5:
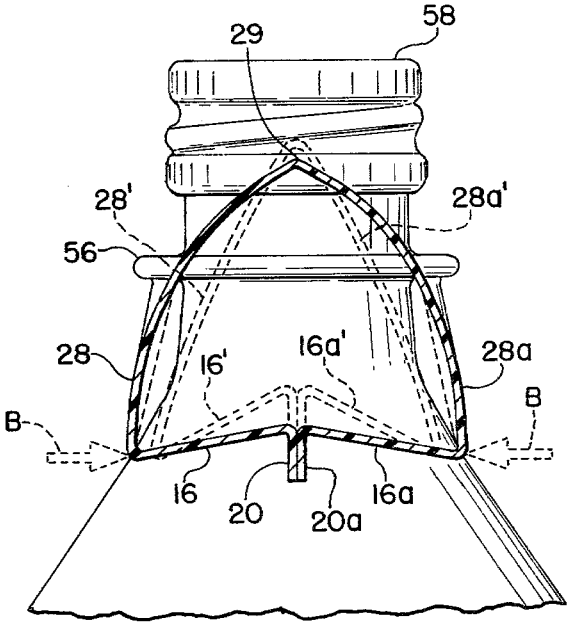
FIG. 5 is a cross-sectional view as taken along the lines 5—5 of FIG. 2.

Turning now to FIG. 5, with continuing reference to FIG. 1, an important aspect of the invention is described. It should be noted from FIG. 1 that the transverse dimension d2 of the central portion 16,16*a* of the bottom wall 14,14*a* is slightly greater than the transverse dimension d1 of the end bottom wall regions 18,18*a*. This has the effect of creating a V-shaped cross section in the central bottom wall as shown in FIG. 5. Thus, while the outer end bottom wall regions 18,18*a* are generally horizontal and planar in configuration, as shown in FIG. 4, the central bottom wall regions 16,16*a* are V-shaped in cross section with the apex directed upwardly. This configuration is assured and maintained by the contact between the end surfaces 24,24*a* of the tabs 20 and 20*a* with the bottles as shown in FIG. 2. Thus, even while the carrier and the bottles in the package are at rest, the central bottom wall is configured as an inverted V so that a person grasping the central region of the package readily compresses the side walls together, such as shown by force arrows BB in FIG. 5. In so compressing the carrier inwardly, the side walls 28,28*a* on central bottom wall 16,16*a* assume the positions 28',28*a*' and 16',16*a*' shown in dotted lines. In so compressing the side walls, the dimension between opposed edges 34,34*a* and 36,36*a* in apertures 30 and 32 is greatly reduced. The inverted V-shaped bottom wall thus creates a package which automatically tightens up the interaction between the carrier and the bottles as it is being handled.

In addition to the enhancement of the security of the package by the V-shaped central bottom wall, the comfortability and feel of the package is further enhanced by the ability to compress the carrier readily when handled. The flexibility just described creates a stronger package rather than a weaker package because of the lessening of the dimensions between the upper apertures and in compressing the side walls 28,28*a*, they assume a configuration similar to a rigid beam.

The tabs 20,20*a* in the central region in cooperation with 22,22*a* in the outermost regions create a further stiffening and stabilizing effect to the package. Edge surfaces 26,26*a* on the tabs 22,22*a* in cooperation with edge surfaces 24,24*a* in the central tabs 16,16*a* stabilize the rather large bottles from movement.

It should be understood that while bend line 29 has been described as a performed line, an uppermost region which is rounded or even flat may be acceptable if side walls 28,28*a* depend downwardly and taper outwardly therefrom.

It also should be understood that the package can be adapted for use with a handle means which may be secured to the central region of the bottom walls 16,16*a* adjacent the bend lines 19,19*a* projecting freely up through the bend line 29 or projecting freely through the side walls adjacent the bend line 29. With such a handle, the carrying forces will be directed almost solely at the apex of the V-shaped bottom wall, pulling the bottom wall upwardly similar to that shown in FIG. 5, thus creating the same effects as the package above-described.

It should also be apparent that the structural features provided by this package permit certain material reducing techniques to be built into the package without reducing the security and reliability of the package. For example, a series of apertures 46 may be formed in the bottom wall to save material or apertures or product names may be imprinted or cut out of the side walls 28,28*a*.

While the bottle shown herein has a greatly enlarged flange region 56 to facilitate the engagement between the bottle and the side edges of the upper apertures in the carrier, it should be understood that the carrier can readily be adapted for use with a more conventional bottle because of the positive bottle supporting features of the package.

Thus there has been described herein, in accordance with the aims of the invention, a package utilizing a carrier that provides a more secure and comfortable carrying arrangement for two or more bottles.

I claim:

1. A carrier for a linear array of bottles having a reduced neck portion and a shoulder means adjacent the upper extremity of the neck portion, the carrier being formed from a sheet of plastic material, the carrier being generally tubular defining an upper region and bottom wall region with side walls extending downwardly and outwardly from the upper region joining the bottom wall region, the upper region and upper marginal surfaces of opposing side walls including a plurality of longitudinally spaced upper apertures centered about a longitudinal axis of the carrier, each aperture providing a pair of opposed side edges in each side wall, the bottom wall including a plurality of longitudinally spaced lower apertures below the upper apertures and in registry therewith, a central portion of the bottom wall intermediate a pair of lower apertures being V-shaped in cross-sectional configuration with the apex of said bottom wall portion directed upwardly so that lateral compressive forces on said side walls readily decrease the transverse dimension between the pair of opposed side edges in the side walls wherein the bottom wall includes end wall portions longitudinally outwardly of the lower apertures and the central wall portion, said end portions of the bottom wall being generally straight and perpendicularly disposed relative to a vertical plane extending longitudinally including the central longitudinal axis of the carrier.

2. The carrier of claim 1, wherein the end wall portions have a surface dimension taken transverse the carrier which is less than the surface dimension taken transverse the carrier of the central V-shaped bottom wall portion.

3. The carrier of claim 1, wherein the bottom wall includes longitudinally extending tabs directed downwardly from the central longitudinal axis of said bottom wall, each tab including end surface means adjacent and on either longitudinal side of the lower apertures.

4. The carrier of claim 1, wherein the upper region consists of a longitudinal bend line about which the side walls are deformed downwardly and outwardly.

5. In a package for bottles having a reduced neck portion and an enlarged shoulder means adjacent the upper extremity of the neck portion including a generally tubular plastic carrier device having a pair of side walls extending downwardly and outwardly from a longitudinal apex region, a plurality of upper longitudinally spaced apertures intersecting said apex region with opposing side edges of each aperture located in opposing side wall regions and in supporting underlying engagement with the enlarged shoulder means of associated inserted container neck portions, a bottom wall portion extending between longitudinal lower marginal edges of said pair of side walls, a plurality of lower longitudinally spaced apertures formed in the bottom wall in registry with the upper apertures, a longitudinal extent of said bottom wall extending between adjacent lower apertures having a lateral cross-sectional configuration which includes a pair of bottom wall halves extending upwardly and inwardly toward each other and a longitudinal center line of the carrier wherein the bottom wall end regions extending longitudinally outwardly of the bottles are generally flat and coplanar with the lower marginal edges of the side walls and the central bottom wall region intermediate the bottles is V-shaped with the apex extending toward the top of the carrier and located in a plane above the plane including the end regions and lower marginal edges of the side walls.

6. The package of claim 5, wherein the central and end bottom wall regions include tabs extending downwardly from the central longitudinal axis of the bottom wall, the edge surfaces of said tabs adjacent the lower apertures abutting the bottles serving to stabilize the package and insure that the central region of the side walls compress easily.

7. The package of claim 5, wherein a pair of bottles are supported in the carrier.

8. The package of claim 5, wherein the upper apertures include laterally spaced straight side edges in opposing side walls, the transverse dimension between said side edges thereby adapted to increase or decrease respectively due to downward compressive force on the top region of the carrier or inward compression on the side walls.

* * * * *